US009329577B2

(12) United States Patent
Kraehenbuehl et al.

(10) Patent No.: US 9,329,577 B2
(45) Date of Patent: May 3, 2016

(54) DEVICE AND METHOD FOR FIXING A MOVEMENT INSIDE A CASE

(71) Applicant: ETA SA MANUFACTURE HORLOGERE SUISSE, Grenchen (CH)

(72) Inventors: David Benjamin Kraehenbuehl, Grenchen (CH); Roger Mueller, Schoenbuehl (CH); Marco Bettelini, Preles (CH); Ines Ruestenberg, Riedholz (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/783,361

(22) PCT Filed: Mar. 27, 2014

(86) PCT No.: PCT/EP2014/056139

§ 371 (c)(1),
(2) Date: Oct. 8, 2015

(87) PCT Pub. No.: WO2014/173611

PCT Pub. Date: Oct. 30, 2014

(65) Prior Publication Data

US 2016/0054707 A1 Feb. 25, 2016

(30) Foreign Application Priority Data

Apr. 23, 2013 (EP) ..... 13164990

(51) Int. Cl.
*G04B 37/05* (2006.01)
*G04B 37/00* (2006.01)

(52) U.S. Cl.
CPC ..... *G04B 37/05* (2013.01); *G04B 37/0058* (2013.01)

(58) Field of Classification Search
CPC .... G04B 37/05; G04B 37/0058; G04B 39/00; G04B 39/006; G04B 21/08; Y10T 29/49579
USPC ..... 368/281, 297
See application file for complete search history.

(56) References Cited

U.S. PATENT DOCUMENTS 4,558,955 A 12/1985 Herchenbach
5,500,835 A 3/1996 Born (Continued)

FOREIGN PATENT DOCUMENTS

EP 0 670 532 A1 9/1995
EP 1 046 967 A1 10/2000

OTHER PUBLICATIONS

International Search Report issued on Jun. 5, 2014 for PCT/EP2014/056139 filed on Mar. 27, 2014.

*Primary Examiner* — Sean Kayes
(74) *Attorney, Agent, or Firm* — Oblon, McClelland, Maier & Neustadt, L.L.P.

(57) ABSTRACT

A timepiece including a case that accommodates a movement including a lower peripheral bearing surface, the case including a case middle to which a back cover and a crystal are respectively assembled. The timepiece further includes a clamping element including a lower retaining surface and the movement includes an upper peripheral bearing surface, the lower retaining surface of the clamping element and the upper peripheral bearing surface being in mutual contact. The back cover includes an annular peripheral shoulder, against which is affixed the lower peripheral bearing surface of the movement, which is compressed between its lower peripheral bearing surface and its upper peripheral bearing surface respectively by the annular peripheral shoulder of the back cover and the lower retaining surface of the clamping element.

10 Claims, 2 Drawing Sheets

(56) References Cited

U.S. PATENT DOCUMENTS 5,901,117 A * 5/1999 Delabre ..... G04B 37/0058 368/276
6,575,619 B1 6/2003 Stauffer
7,988,350 B2 * 8/2011 Bonnet ..... G04B 37/0008 368/280
8,411,533 B2 * 4/2013 Mieville ..... G04B 21/08 368/244
8,876,371 B2 * 11/2014 Behrend ..... G04B 37/052 368/281
2002/0131332 A1 9/2002 Kaelin et al.

* cited by examiner

DEVICE AND METHOD FOR FIXING A MOVEMENT INSIDE A CASE

CROSS-REFERENCE TO RELATED APPLICATIONS

This is a National Phase Application in the United States of International Patent Application PCT/EP2014/056139 filed on Mar. 27, 2014 which claims priority on European Patent Application No. 13164990.7 filed on Apr. 23, 2013. The entire disclosure of the above patent applications are hereby incorporated by reference.

The present invention concerns a device and a method for fixing a movement inside a watch case, and in particular a movement inside the case of a diving watch.

BACKGROUND OF THE INVENTION

In the field of horology, the plates on which movements are arranged generally contain a thread, i.e. an upper edge which is provided for attaching the movement to the case. To this end, the thread can be secured with the aid of clamps and screws which are inserted into threaded holes and thus pressed against a shoulder of the case middle. Although this type of attachment has the advantage of being reliable and reversible, it also has the drawback of being relatively complex to implement due to the various manipulations required for the screws and clamps, which seriously affects productivity and makes this method unsuitable for the manufacture of watches intended for mass production.

US Patent Publication No 2002/0131332 by the Applicant describes an alternative method for attaching a movement which does not require the use of a thread or clamps, but still uses a securing screw. A first series of screws is inserted in through holes arranged at the periphery of the movement to assemble the latter to a bezel, while the back cover is then assembled to the same bezel using a second series of screws. Thus, although the central element for this type of attachment is no longer the case middle, but the bezel of a watch, the same drawbacks in terms of productivity nonetheless remain, and are even accentuated due to the increased number of screwing operations required during assembly of the movement.

This is why press-fit attachment methods are sometimes preferred, usually with the aid of intermediate parts such as casing rings, which also allow small calibrated movements to be fitted in larger cases.

The solution described in EP Patent No 1046967 by the Applicant concerns, for example, such a method for attaching a movement with the aid of a casing ring made of a plastically deformable material intended to allow the radial or axial adjustment of the movement in a determined position with respect to the case.

Regardless of the attachment method chosen, the lower rim of the thread is always made to abut against a portion of the case middle, and the shape of the case back, which may or may not be integral with the case middle, matches that of the lower portion of the movement to within machining tolerances. U.S. Pat. No. 4,558,955 describes such a solution for attaching a movement, wherein the movement is directly accommodated in a hollow in a one-piece case middle-back cover and is held axially between the bottom of this hollow, against which it abuts, and the dial, retained by the crystal. The drawback of this type of attachment method is that any deformation of the back cover, particularly during subaquatic use, is directly replicated on the plate, and the latter is particularly sensitive.

To prevent any inadvertent deformation of the constituent parts of the watch, an alternative consists, especially for plastic watches, in using reinforced structures containing, for example, frames made of metal or other types of materials for strengthening the case. This alternative cannot, however, be envisaged if it is wished to maintain the attractive features of the case, particularly if the case is required to remain at least partially transparent.

Otherwise, there are also known structures with a double back cover for watches accommodating other internal modules in addition to the movement. EP Patent No 0670532 concerns, for example, a watch provided with a pressure sensor and describes a movement assembled in a conventional manner to a case middle with the aid of a casing ring, while an inner back accommodates the pressure sensor, covered by the back cover of the case. Such a structure has the drawback, however, of adding considerable thickness to the case and also slowing down production time due to the doubling of assembly operations for each of the backs.

There therefore exists a need for a method and a device for attaching a movement inside a case that is free of these known limitations.

SUMMARY OF THE INVENTION

To this end, the present invention concerns a timepiece including a case which accommodates a movement including a lower peripheral bearing surface, the case including a case middle to which a back cover and a crystal are respectively assembled. The timepiece is characterized in that it also includes a clamping element provided with a lower retaining surface and in that the movement includes an upper peripheral bearing surface, the lower retaining surface of the clamping element and the upper peripheral bearing surface being in mutual contact, and in that the back cover includes an annular peripheral shoulder, against which is affixed the lower peripheral bearing surface of the movement, which is compressed between its lower peripheral bearing surface and its upper peripheral bearing surface respectively by the annular peripheral shoulder of the back cover and the lower retaining surface of the clamping element.

The present invention also concerns a back cover for such a timepiece, taken separately, characterized in that it includes a hollowed central portion of variable thickness and an annular peripheral shoulder of constant thickness.

Finally, the present invention also concerns a preferred assembly method for obtaining such a timepiece. The method is characterized in that the assembly of the movement in the case includes the following steps:

- inserting the movement in the case from the dial side;
- affixing a lower peripheral bearing surface of the movement against an annular peripheral shoulder of the back cover, then
- clamping said movement against the back cover by means of a clamping element abutting against an upper peripheral bearing surface of the movement, such that the movement is compressed between its lower peripheral bearing surface and its upper peripheral bearing surface respectively by the annular peripheral shoulder of the back cover, and a lower retaining surface of the clamping element.

One advantage of the present invention is that it allows any deformations of the back cover to be better absorbed, for example in the event of substantial variations in pressure or temperature, owing to the complete dissociation of the inner surface of the back cover from the movement. This therefore prevents any detrimental torsional stress being exerted on the plate and therefore on all the elements of the movement, notably the arbors and bridges.

According to the preferred assembly method, the movement is inserted from the top of the case, on the dial side, which avoids turning the case over during assembly and thereby advantageously increases production rates.

BRIEF DESCRIPTION OF THE DRAWINGS

Other features and advantages of the invention will become clear from the detailed description and drawings, given by way of non-limiting example, in which.

DETAILED DESCRIPTION

Figure 1:
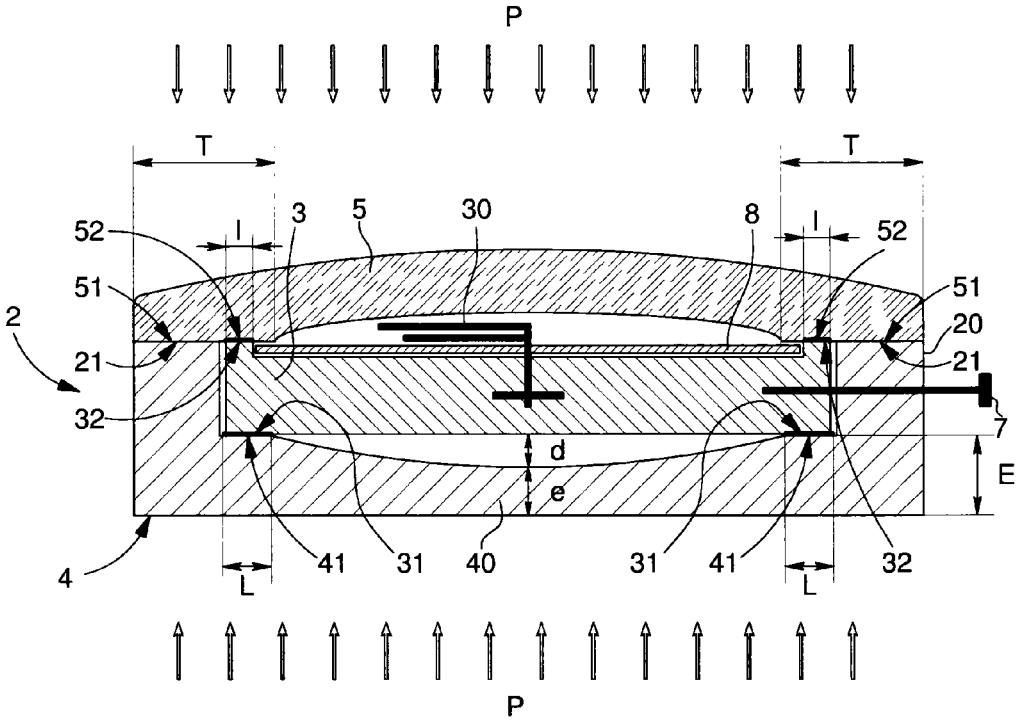
FIG. 1 shows a sectional view of a schematic diagram of the assembly of a movement in a case according to a preferred embodiment of the invention.

FIG. 1 illustrates a sectional view of a timepiece according to a preferred embodiment of the invention in an assembled position, wherein the movement 3, to which is attached a control stem 7 and which drives hands 30 above a dial 8, is assembled in case 2 by a method corresponding to a preferred embodiment of the invention. According to this preferred embodiment, the case contains a one-piece back cover-case middle, i.e. the back part 4 is made in a single piece with the case middle 20 forming the central portion of case 2. This one-piece part simplifies the assembly process of movement 3 by removing an assembly step; in this case, movement 3 can be directly inserted from the top of case 2, i.e. from the dial side, with no requirement to subsequently assemble the back cover or turn over case 2 to insert the movement. It will be understood, however, that the assembly method of the invention also applies to a back cover 4 that is snapped in, screwed or adhesive bonded to case middle 20, or assembled by any other usual attachment method. Nonetheless, the step of assembling back cover 4 to case middle 20 will preferably be performed prior to insertion of movement 3 in the case, so that the latter is still inserted from the dial side.

At the edge of its inner surface, back cover 4 includes a peripheral annular shoulder 41 having a first width (L), on which movement 3 abuts, and a hollow central portion 40 of depth (d). The lower peripheral bearing surface 31 of movement 3 is at least partially superposed on an upper peripheral bearing surface 32 of movement 3, having a second width (I), which is clamped by the lower retaining surface of a clamping element, formed here by a portion 52 of the heel 51 of crystal 5, having a third width (T), a lower surface of which abuts on the upper peripheral bearing surface 32 of movement 3.

According to a preferred embodiment, there is selected a first width L of lower peripheral bearing surface 31 of movement 3 larger than the second width I of upper bearing surface 32, but this is compensated by a third width T of base 51, which is selected to be larger than first width L of lower peripheral bearing surface 31 of movement 3, in order to obtain the clamping and symmetrical compression of movement 3 at the periphery thereof which generates the minimum torsional torque.

At annular peripheral shoulder 41, the thickness of the back cover is constant and equal to (E), whereas this thickness varies over the entire hollow central portion 40 and is minimal at the centre of back cover 4, having a value of (e). As can be seen in FIG. 1, we have the equality e+d=E. The hollow central portion 40 allows back cover 4 to deform slightly, especially at the centre thereof, when forces due to pressure, represented by arrows (P), are exerted on case 2, for example during immersion to a depth of more than ten or so meters or more than one additional bar is applied to the whole of the outer surface of the case—which is the equivalent of double the surrounding pressure—without thereby affecting the movement, which is clamped between its lower and upper peripheral bearing surfaces 31 and 32 but is not in contact with back cover 4 in its hollow central portion 40. Thus, case 2 is robust at pressure values such that the curvature of the back cover is not reversed to the extent that hollow central portion 40 of back cover 4 is brought into contact with movement 3 again. To facilitate the torsional deformation of back cover 4 and prevent the transmission of stress at the peripheral clamping areas of movement 3, the shape of hollow central portion 40 of back cover 4 is preferably selected to be parabolic.

Within the scope of the invention, movement 3 has a diameter preferably comprised between 25 and 40 millimeters, and first width L of annular peripheral shoulder 41 of back cover 4 is in that case preferably selected to be comprised between 2 and 5 millimeters. More generally, the first width L of peripheral shoulder 41 of the back cover is selected to be comprised between a quarter and a tenth of the value of the diameter of movement 3 to improve the clamping effect at the periphery thereof while also allowing back cover 4 to deform more easily under the effect of outside stress forces. For a maximum thickness E of back cover 4 comprised between 3 and 5 mm and a minimum thickness e of said back cover comprised between 2.5 and 4 mm, case 2 can therefore withstand a pressure on the order of at least 35 bars.

In FIG. 1, it can be observed that base 51 of crystal 5 is brought into contact on a shoulder 21 of case middle 20 in the extension of portion 52 abutting on upper peripheral bearing surface 32 of movement 3. According to this preferred embodiment, the step of clamping movement 3 between its lower and upper peripheral parts 31 and 32 is performed jointly with the mounting of crystal 5 on case middle 20, preferably by ultrasound welding. The assembly structure obtained has the advantage of relieving torsional stresses on the welded part owing to upper peripheral bearing surface 32 of movement 3, which axially extends the shoulder of case middle 21 and thereby improves the robustness and durability of the connection between the welded parts.

According to the preferred embodiment illustrated, the fact that lower and upper bearing surfaces 31 and 32 are partially superposed also allows the integrity of movement 3 to be maintained, by avoiding the application of a torsional stress which would tend to deform the movement due to opposing stress forces of a similar standard exerted on areas whose distance from the centre would be very different.

This protection of the movement from the deformations of the case is further enhanced by the fact that, in the preferred embodiment illustrated, heel 51 of the crystal, whose third width T is preferably comprised between 4 and 8 millimeters, is entirely superposed on the annular peripheral shoulder 41, in order to further improve the clamping effect. For reasons of symmetry, and thus of optimum stress distribution intended to minimise the production of torsional torque, third width T of heel 51 will also preferably be selected to be at most equal to two times first width L of annular peripheral shoulder 41.

It will be noted that movement 3 of FIG. 1 has been shown without a thread, since, unlike in conventional movements, the thread is not used to provide a stop or snap fit surface during assembly of the movement in case 2.

Figure 2A:
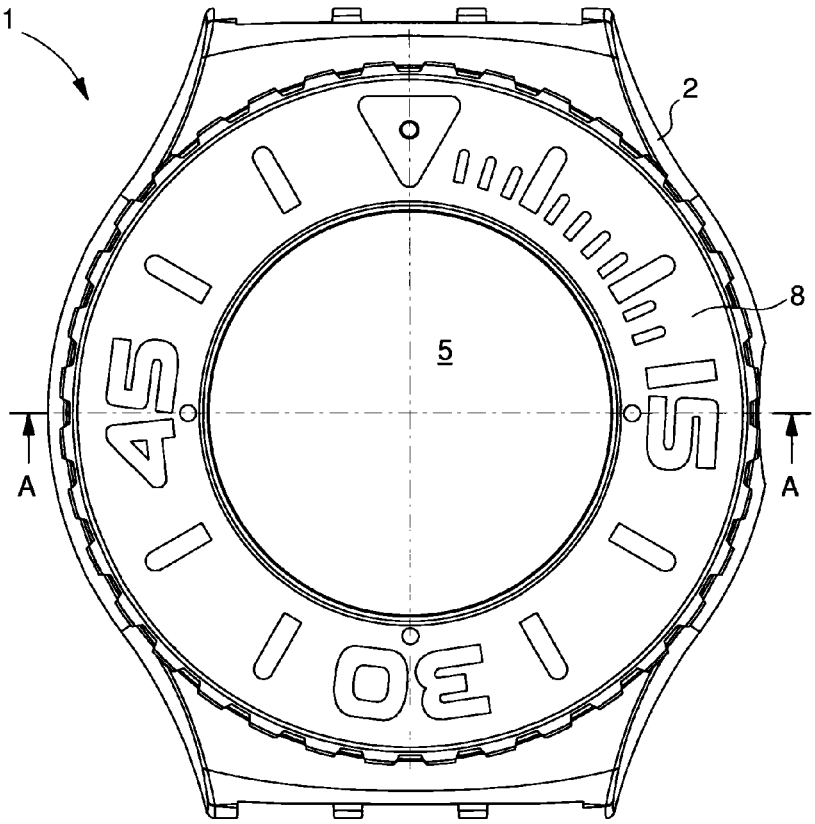
FIGS. 2A and 2B respectively show a top view and a sectional view of a diving watch using the assembly method according to a preferred embodiment.
Figure 2B:
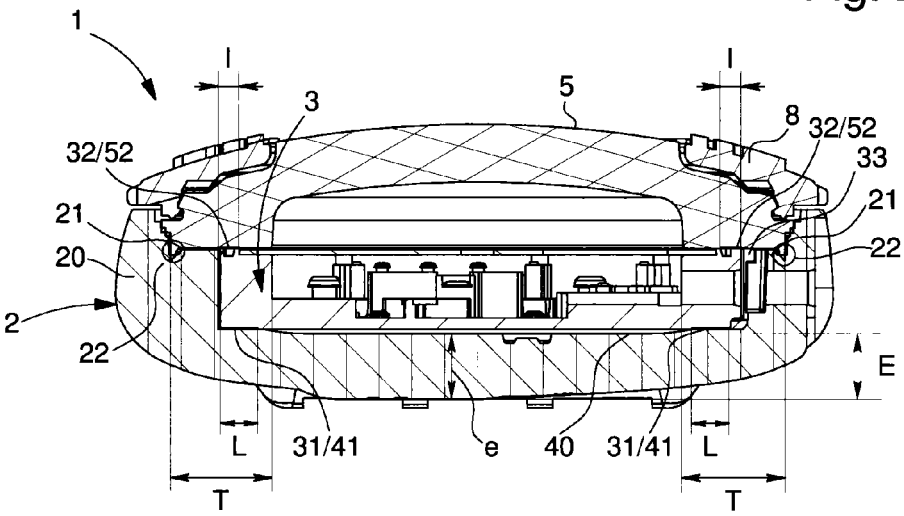

FIGS. 2A and 2B respectively show a top view and sectional view along an axis A-A of a preferred embodiment for the method of assembling movement 3 in a case 2 according to the invention for a timepiece 1 corresponding to a diving watch.

FIG. 2A is a top view of the diving watch, showing case 2, and crystal 5 surmounted by a bezel 8. FIG. 2B reveals the parts inside case 2, and in particular movement 3 which, in a conventional manner, is provided with a thread 33 on the upper part thereof. This thread 33 is not provided, however, to ensure the axial holding of movement 3 in case 2, this function being performed by annular peripheral shoulder 41 of back cover 4 and portion 52 of heel 51 of crystal 5, which respectively sandwich the lower and upper peripheral bearings surfaces 31 and 32 of movement 3 to clamp the movement when crystal 5 is welded to shoulder 21 of case middle 20 at heat welding area 22 represented by the small beak-shaped portion descending at the periphery of heel 51. Thus at the same time that the crystal is heat welded to case middle 20, movement 3 is clamped between a portion 52 of heel 51 of crystal 5 and the annular peripheral shoulder 41 of back cover 4. Bezel 8 could be subsequently snapped onto crystal 5.

As can be observed in FIG. 2B, according to this preferred embodiment, which is used for a movement with a diameter of around 33 millimeters, the lower peripheral bearing surface 31 of the movement, having a first width L equal to 4 millimeters like that of annular peripheral shoulder 41 of back cover 4, which compresses it via back cover 4, and upper peripheral bearing surface 32 of the movement, having a second width I equal to 2.5 millimeters like portion 52 of heel 51 of crystal 5, which compresses it from above, are entirely superposed, such that the clamping thereby created produces the minimum torsional torque at the periphery of the movement. Likewise, heel 51 has a third width T of 7 to 8 millimeters and is entirely superposed on annular peripheral shoulder 41 for the same reasons of minimisation of torsional deformation stresses on movement 3. For reasons of symmetry and to relieve the stresses exerted on heat welding area 22, heel 51 will include an inwardly extending portion on the opposite side to that of heat welding area 22 with respect to the portion 52 clamping the movement on its upper bearing surface 32.

According to this preferred embodiment, the thickness E of the back cover is around 3 millimeters and its minimum thickness e is 2.5 millimeters, leaving an indentation around 0.5 millimeters deep at the centre. The hollow central portion 40 of back cover 4 preferably has a parabolic shape to facilitate the deformation of back cover 4 and to optimise the distribution of stress forces exerted on case back 2. Again for reasons of symmetry and optimum distribution of stress forces resulting from pressure, crystal 5 preferably has a similar shape and thickness to that of back cover 4.

In the preferred embodiment of the invention, the preferred assembly structure obtained after the operation of clamping movement 3 between its lower and upper peripheral bearing surfaces 31 and 32 directly involves a portion 52 of heel 51 of crystal 5 as the lower retaining surface of a clamping element, and a laser welding operation, which not only eliminates a part dedicated to the axial holding of movement 3, pressed against annular peripheral shoulder 41 of back cover 4 by crystal 5, acting as clamping element, but also dispenses with a dedicated operation for the attachment of movement 3, since the latter is secured to the back cover at the same time that crystal 5 is welded to case middle 20. The reduction in the number of parts and assembly operations necessary to attach the movement thus not only decreases production costs but increases productivity. Instead of laser welding, other attachment methods could be envisaged, for example brazing, adhesive bonding or pressing-in, without departing from the scope of the invention and moreover, according to an alternative embodiment that is not shown, it is also possible to envisage inserting an intermediate part, such as a ring, between crystal 5 and movement 3, or directly assembling another part, used for clamping, to case middle 20 without involving crystal 5, such as for example a part of L-shaped section, wherein a first side which includes the lower clamping surface, is placed above the thread of movement 3 and the second side is pressed into a circular rib of case middle 20.

It will also be noted that the parts assembled within the scope of the present invention and especially back cover 4, are preferably made of plastic material. The present invention however also encompasses cases 2, especially for diving watches, including back covers 4 made of steel or metal, which although more rigid, are not however free of any deformation at very high pressures.

LIST OF REFERENCES

1 Timepiece
2 Case
20 Case middle
21 Case middle shoulder
22 Case middle/crystal heat welding area
3 Movement
30 Hands of the movement
31 Lower annular bearing surface of the movement
32 Upper annular bearing surface of the movement
33 Thread of the movement
4 Back cover
40 Hollow portion of the back cover
41 Annular shoulder of the back cover
5 Crystal
51 Heel of the crystal
52 Portion of the crystal base abutting on surface 32 of the movement
6 Dial
7 Control stem
8 Bezel
E (Maximum) thickness of the back cover
e (Minimum) thickness of the back cover
d Depth of the recess of central portion 40.
L First width of the lower bearing surface
I Second width of the upper bearing surface
T Third width of the base of crystal 51
A-A Cross-sectional axis of Figure 2A

The invention claimed is:

1. A timepiece comprising:

a case which accommodates a movement including a lower peripheral bearing surface, the case including a case middle to which are respectively assembled a back cover and a crystal;

a clamping element including a lower retaining surface; and the movement includes an upper peripheral bearing surface, the lower retaining surface of the clamping element and the upper peripheral bearing surface being in mutual contact, and wherein the back cover includes an annular peripheral shoulder of constant thickness against which is affixed the lower peripheral bearing surface of the movement, and a hollow central portion of variable thickness and parabolic shape, the movement being compressed between the lower peripheral bearing surface and the upper peripheral bearing surface of the movement, the lower and upper peripheral bearing surfaces of the movement being at least partially superposed, respectively by the annular peripheral shoulder of the back cover, and the lower surface of the clamping element.

2. The timepiece according to claim 1, wherein the lower retaining surface of the clamping element is formed by a portion of a heel of the crystal.

3. The timepiece according to claim 2, wherein the back cover and the case middle form a one-piece part.

4. The timepiece according to claim 2, wherein the base of the crystal is entirely superposed on the annular peripheral shoulder of the back cover.

5. The timepiece according to claim 2, wherein the movement has a diameter between 25 and 40 millimeters, and wherein the peripheral shoulder of the back cover extends over a first width of at most 5 millimeters, the base of the crystal over a third width of at most 8 millimeters, and the portion of the base over a second width of at most 4 millimeters.

6. The timepiece according to claim 1, wherein the back cover includes an annular peripheral shoulder of constant thickness and a hollow central portion of variable thickness and parabolic shape.

7. The timepiece according to claim 6, wherein the maximum thickness of the back cover is between 3 and 5 mm, and the minimum thickness of the back cover is between 2.5 and 4 mm.

8. The timepiece according to claim 6, wherein the width of the peripheral shoulder is between a quarter and a tenth of the value of the diameter of the movement.

9. An assembly method for a timepiece according to claim 1, wherein assembly of the movement in the case comprises:

inserting the movement in the case from a dial side;

affixing a lower peripheral bearing surface of the movement against an annular peripheral shoulder of constant thickness of the back cover, the back cover further including a hollow central portion of variable thickness and parabolic shape; and then clamping the movement against the back cover by a clamping element abutting against an upper peripheral bearing surface of the movement, such that the movement is compressed between the lower peripheral bearing surface of the movement and the upper peripheral bearing surface of the movement, the lower and upper peripheral bearing surfaces of the movement being at least partially superposed, respectively by the annular peripheral shoulder of the back cover, and a lower retaining surface of the clamping element.

10. The assembly method for a timepiece according to claim 9, wherein the back cover and the case middle form a one-piece part, the lower retaining surface of the clamping element is formed by a portion of the heel of the crystal, and wherein the clamping is performed jointly with the assembling the crystal to the case middle.

* * * * *